US005881553A

United States Patent [19]

Steenackers et al.

[11] Patent Number: 5,881,553

[45] Date of Patent: Mar. 16, 1999

[54] EXHAUST MANIFOLD

[75] Inventors: Pieter Delfina Steenackers, Heverlee, Belgium; Adrianus J. F. Hoefnagels, Asten, Netherlands

[73] Assignee: Scambia Industrial Developments Aktiengesellschaft, Schaan, Liechtenstein

[21] Appl. No.: 862,525

[22] Filed: May 23, 1997

[30] Foreign Application Priority Data

May 23, 1996 [CH] Switzerland ..... 1299/96

[51] Int. Cl.[6] ..... F01N 3/15

[52] U.S. Cl. ..... 60/299

[58] Field of Search ..... 60/299, 323; 422/180

[56] References Cited

U.S. PATENT DOCUMENTS

| | | | |
|---|---|---|---|
| 3,692,497 | 9/1972 | Keith et al. | 60/299 |
| 5,094,074 | 3/1992 | Nishizawa et al. | 60/299 |
| 5,144,797 | 9/1992 | Swars | 60/299 |
| 5,395,600 | 3/1995 | Cornelison | 60/299 |
| 5,552,123 | 9/1996 | Numoto et al. | 60/299 |
| 5,666,805 | 9/1997 | Bloedel-Pawlik et al. | 60/299 |
| 5,693,295 | 12/1997 | Foster | 60/299 |

FOREIGN PATENT DOCUMENTS

| | | |
|---|---|---|
| 0420462 | 4/1991 | European Pat. Off. . |
| 9313593 | 1/1994 | Germany . |
| 4317092 | 11/1994 | Germany . |
| 1405068 | 9/1975 | United Kingdom . |

*Primary Examiner*—Marguerite McMahon
*Attorney, Agent, or Firm*—Anderson, Kill & Olick, P.C.

[57] ABSTRACT

The exhaust manifold has a plurality of individual pipes each having an inlet which is detachably connected to an exhaust gas outlet of an internal combustion engine. Each individual pipe has a catalytic converter section which makes an angle with the inlet, defines a catalytic converter axis and contains catalyst means for the catalytic treatment of the exhaust gas. In a cross-section at right angles to the catalytic converter axis, the catalyst means have a cross-sectional area which is greater than the inlet orifice area of the inlet so that the catalyst means cause only a relatively low resistance to flow when exhaust gas is passed through.

24 Claims, 3 Drawing Sheets

EXHAUST MANIFOLD

BACKGROUND OF THE INVENTION

1. Field of the invention

The invention relates to an exhaust manifold.

The exhaust manifold may form part of an exhaust system for an internal combustion engine of a motor vehicle. The internal combustion engine consists, for example, of a gasoline engine and has, for example, a plurality of cylindrical combustion chambers in which a piston which can be moved back and forth is arranged. However, the engine might instead be in the form of a rotary piston engine and have combustion chambers containing a rotary piston. Each combustion chamber is connected to an exhaust outlet of the internal combustion engine.

2. Description of the prior art

An exhaust manifold disclosed in German Utility Model 295 05 660 has a plurality of individual pipes which are formed from straight pipe sections and whose inlets can be connected to the exhaust outlets of the internal combustion engine and whose ends facing away from the inlets enter a horizontal collecting pipe at right angles to their axes. Each pipe section contains catalyst means not described in detail. The cross-sectional areas of the catalyst means present in the pipe sections or individual pipes are evidently at most about the same size as the cross-sectional areas of the inlet orifices of the pipe sections. The catalyst means therefore give rise to a large resistance to flow and a large pressure drop or opposite pressure which reduces the effective power of the engine. Moreover, the collecting pipe also contains catalyst means which further increase the resistance to flow and the opposite pressure. Since the exhaust outlets of the engines generally have approximately horizontal axes and are often arranged fairly high up on the engine and relatively high above the vehicle bottom, for space reasons it is often inexpedient to connect the exhaust outlets of the engine to a horizontal collecting pipe by straight pipe sections.

FIGS. 7 to 10 of French Publication 2 179 689 show exhaust manifolds having a plurality of pipes which are connected to exhaust outlets of an internal combustion engine and contain catalyst means. However, the catalyst means of this exhaust manifold also have only small cross-sectional areas transverse to the direction of flow of the exhaust gases flowing through them or require a plurality of sharp deflections of the exhaust gas and the passage of the exhaust gas through cavities having small cross-sectional areas. The catalyst means and/or the gas passage from and to the catalyst means therefore give rise to high resistances to flow and opposite pressures in these known exhaust manifolds too and, particularly in the case of the variants according to FIGS. 9 and 10, inhomogeneous flow distributions in the catalyst means.

German Publication 42 36 893 discloses an exhaust pipe connected to an exhaust outlet of an internal combustion engine. A curved section of this contains catalyst means having a stack of plates. These catalyst means have the disadvantages that their cross-sectional areas are at most approximately the same as those of the passage of the remaining pipe and that their exhaust gas passages are of different lengths depending on the radius of curvature, so that the exhaust gas is purified to different extents in the various passages. Furthermore, the production of such catalyst means is difficult and expensive.

U.S. Pat. Ser. 5 330 728 discloses catalytic converters whose housing has an inlet, a catalytic converter section containing catalyst means and an outlet. The inlet and the outlet are offset relative to one another and have axes parallel to one another, while the axis of the catalytic converter section and the passages of the catalyst means are inclined relative to these axes. The exhaust gas entry surface and the exhaust gas exit surface of the catalyst means are flat and parallel to the axes of the inlet and outlet. These catalytic converters are apparently intended to be arranged below the vehicle bottom and not to be arranged in the individual pipes of an exhaust manifold. For space reasons, it would also not be expedient to install such catalytic converters in an exhaust manifold. Furthermore, the exhaust gas is greatly deflected immediately after the catalyst means, the housing having, on one side of the exhaust gas exit surface of the catalyst means, a wall which is directly adjacent to said surface and which makes a fairly acute angle with the exhaust gas exit surface. During operation, a pressure gradient therefore forms over the exhaust gas exit surface and influences the exhaust gas flow in the catalyst means and makes it inhomogeneous. This impairs the efficiency of the catalyst means.

SUMMARY OF THE INVENTION

It is the object of the invention to provide an exhaust manifold which avoids disadvantages of the known exhaust manifolds. It is intended in particular to ensure that the catalyst means permits good purification of the exhaust gas with as small an increase as possible in the resistance to flow and opposite pressure, that the exhaust gas flow in the catalyst means is distributed as uniformly as possible, that the supply of the exhaust gas to the catalyst means and the removal of the exhaust gas in the discharge section of the pipes which is directly adjacent to the catalyst means give rise to only very small resistances to flow, and that equipping the exhaust manifold with catalyst means increases its space requirement only slightly and does not make the exhaust manifold much more difficult to install.

This object is achieved, according to the invention, by an exhaust manifold having at least two pipes, each of which has an inlet intended for connection to an internal combustion engine and a catalytic converter section making an angle with said inlet, which catalytic converter section contains catalyst means for the catalytic treatment of exhaust gas and defines a catalytic converter axis, wherein the inlet has an inlet orifice area, wherein the catalyst means have a cross-sectional area in a cross-section at right angles to the catalytic converter axis and wherein the cross-sectional area of the catalyst means is greater than the inlet orifice area.

According to the invention, each exhaust manifold pipe intended for connection to the internal combustion engine contains catalyst means. The catalyst means can therefore be arranged so close to the engine that the exhaust gas is only slightly cooled between the internal combustion engine and the catalyst means during a cold start and, during a cold start, the catalyst means are heated in a short heat-up time to a temperature which permits efficient catalytic treatment of the exhaust gas.

The catalyst means arranged in the various pipes of the exhaust manifold may have relatively large cross-sectional areas transverse to their exhaust gas passages, which areas are preferably substantially greater than the areas of the inlet orifices of the pipes. Furthermore, the exhaust gas passed through the pipes of the exhaust manifold during the use of the latter can be distributed over the exhaust gas entry surfaces of the catalyst means in such a way, and removed from the catalyst means into the discharge space directly adjacent to the exhaust gas exit surfaces of the catalyst means in such a way, that the flow distribution in the catalyst means is very uniform over the entire cross-sectional area of said discharge space, which area has exhaust gas passages. This permits optimal utilization of the entire catalyst means and high efficiency thereof. Furthermore, the exhaust gas can be distributed over the exhaust gas entry surface of the catalyst means in such a way, and removed from said means in such a way, that only a small opposite pressure is generated. In addition, the exhaust manifold requires little space and can easily be installed in motor vehicles, in particular cars and trucks and especially cars.

BRIEF DESCRIPTION OF THE DRAWINGS

The subject of the invention is illustrated below with reference to embodiments shown in the drawings. In the drawings.

DESCRIPTION OF THE PREFERRED EMBODIMENTS

Figure 1:
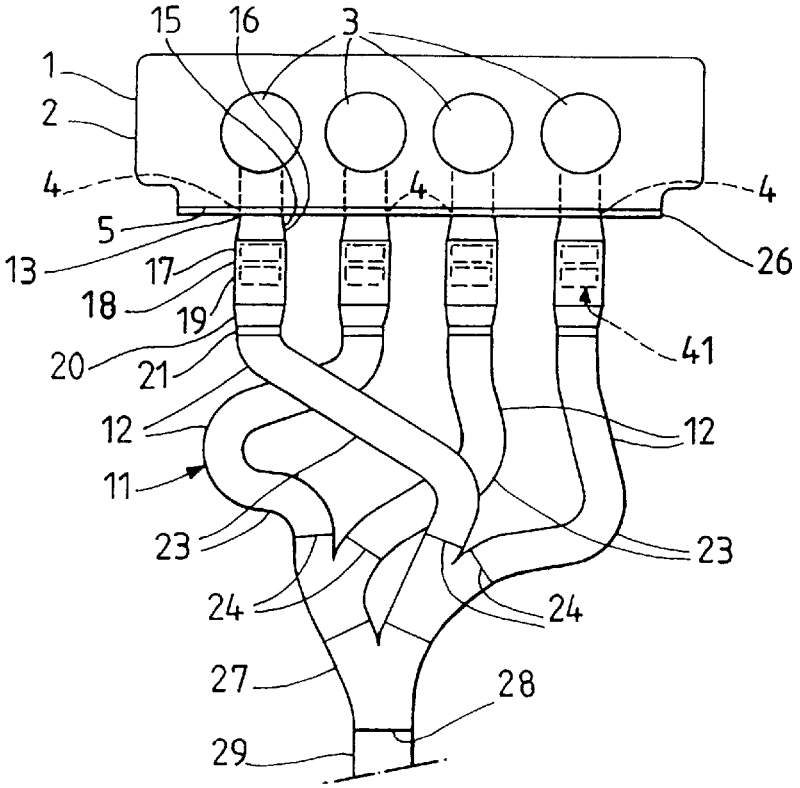
FIG. 1 shows a schematic representation of an internal combustion engine and an exhaust manifold.
Figure 2:
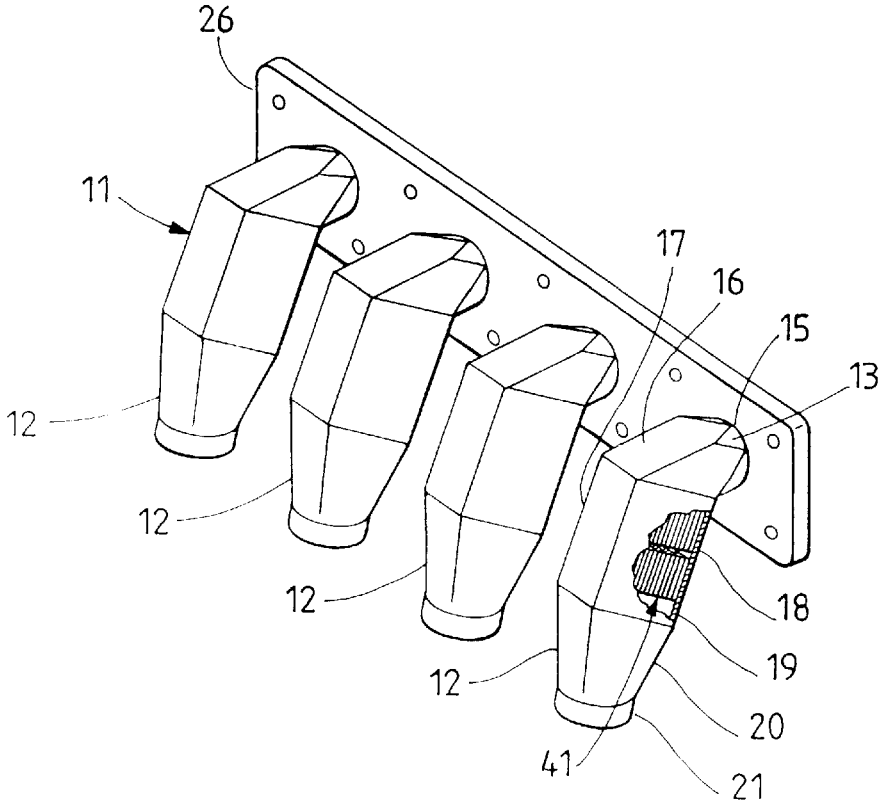
FIG. 2 shows a simplified oblique view of a part of the exhaust manifold.
Figure 3:
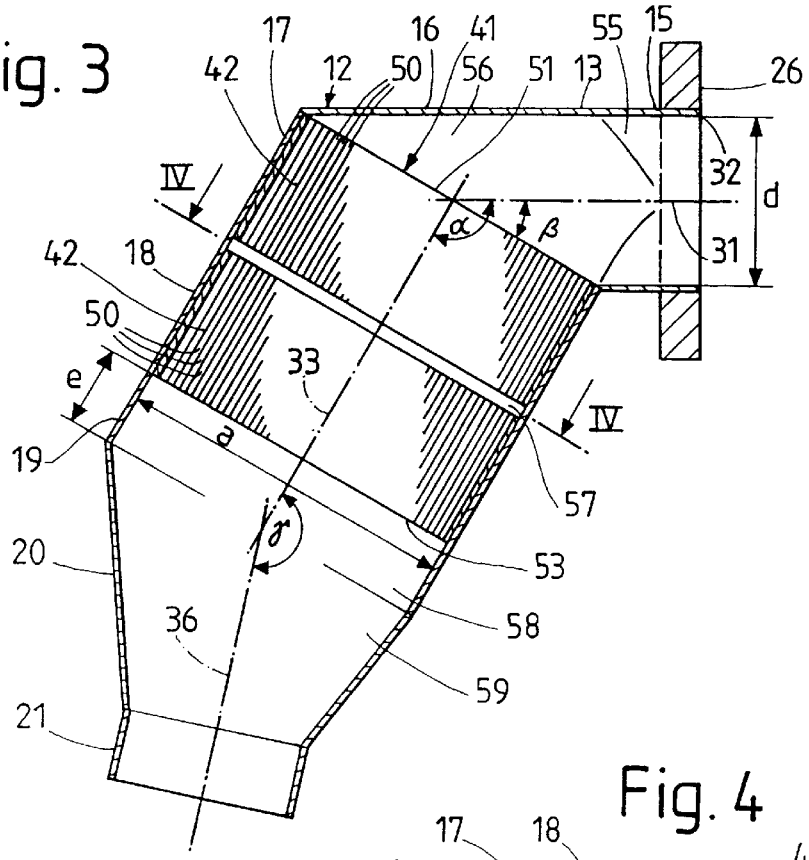
FIG. 3 shows a section through a part of one of the individual pipes of the exhaust manifold and the catalyst means arranged in the individual pipe.
Figure 4:
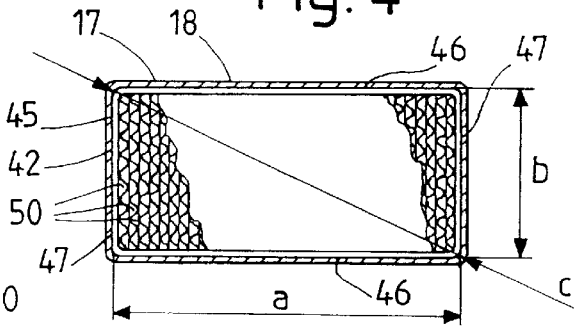
FIG. 4 shows a cross-section through an individual pipe along the line IV—IV of FIG. 3.

The internal combustion engine 1 shown in FIG. 1 is installed in a motor vehicle—for example in a car—and consists of a gasoline engine. The internal combustion engine 1 is shown in plan view and has an engine housing 2 and at least two and, for example, four cylinders. The cylinders bound combustion chambers 3 and each contain a piston which is displaceable back and forth. Each combustion chamber 3 is connected to an exhaust outlet 4. The four exhaust outlets have circular orifices which lie, for example, in a common flat and approximately vertical connection surface 5 of the engine housing 2. The motor vehicle has an exhaust manifold 11 which is shown schematically in FIG. 1, partly in plan view and partly as a developed view, and is also visible in part in FIGS. 2 to 4.

The exhaust manifold 11 has at least two, namely four, individual pipes 12 with a metallic, rigid wall, for example consisting of stainless steel. Each individual pipe 12 has an approximately horizontal first limb 13 which is tightly connected to one of the exhaust outlets 4 of the engine and has an inlet 15 and an exhaust gas distributor 16. The first limb 13 is connected to a second limb 17 which makes an angle with said first limb and runs downward away from the first limb. Said second limb has, in sequence in a direction away from the first limb, a catalytic converter section 18, a discharge section 19, a transition section 20 and a connecting section 21. The second limb 17 is connected to the main section 23 of the individual pipe 12 at the connecting section 21. Said individual pipe has an outlet 24.

The exhaust manifold 11 is provided, at the inlets 15, for example with a metallic, generally flat connecting plate 26 which consists, for example, of stainless steel and has a hole for each pipe 12 and is nondetachably connected, for example welded, to the initial sections of all four inlets 15. The connecting plate 26 is adjacent to the connecting surface 5 of the engine housing 2 and is detachably fastened to the engine housing by fastening means, for example bolts or the like. The exhaust manifold 11 furthermore has a collecting and connecting means 28. This is composed, for example, of three Y-shaped connecting members and has four inlets, each of which is connected to an outlet 24 of an individual pipe 12. The collecting and connecting means 28 furthermore has an outlet which forms the outlet 28 of the entire exhaust manifold 11, common to all individual pipes 12, and is connected to an exhaust pipe 29.

Each inlet 15 has a straight, approximately horizontal inlet axis 31 and, at its beginning connected to the engine housing 2, a circular inlet orifice 32 rotationally symmetrical with respect to the inlet axis. The catalytic converter section 18 and the discharge section 19 have a common straight catalytic converter and discharge axis 33 which intersects the inlet axis 31 and, for example, is in an approximately vertical plane. The transition section 20 defines a transition axis 36 intersecting the axis 33. The inlet 15 has, at its beginning, a short cylindrical and/or conical casing or wall section and gradually becomes quadrilateral in a direction away from the inlet orifice. The wall of the exhaust gas distributor 16 has, on both sides, a lateral wall section which is approximately flat and parallel to a plane through the axes 31, 33. The distributor 16 furthermore has a flat top wall section which is at right angles to the last-mentioned plane and, for example, approximately parallel to the inlet axis 31. The distributor 16 is open at the bottom and has a quadrilateral, namely rectangular, edge lying in a plane inclined relative to the inlet axis. The catalytic converter section 18 and the discharge section 19 together consist of a pipe section or casing which is essentially quadrilateral, namely rectangular, in cross-section and parallel to the axis 33. The rectangle formed by said pipe section or casing in cross-section has two longer rectangle sides which are parallel to the plane passing through the axes 31, 33. The casing forming the catalytic converter section and discharge section has, at both ends, edges lying in planes at right angles to the axis 33. The transition section 20 is quadrilateral, namely rectangular, at its upper end, gradually becomes circular in cross-section in a downward direction and is associated at its lower end with the short connecting section 21 which is circular, in cross-section, for example cylindrical. Those main sections 23 of the pipes 12 which connect to the connecting sections 21 consist of pipes which are circular in cross-section and-bent in their longitudinal directions. The two limbs 13, 17 are, for example, approximately or exactly the same in the case of all pipes 12, whereas the main sections 23 differ but are bent in such a way that all pipes 12 have approximately the same length.

Figure 5:
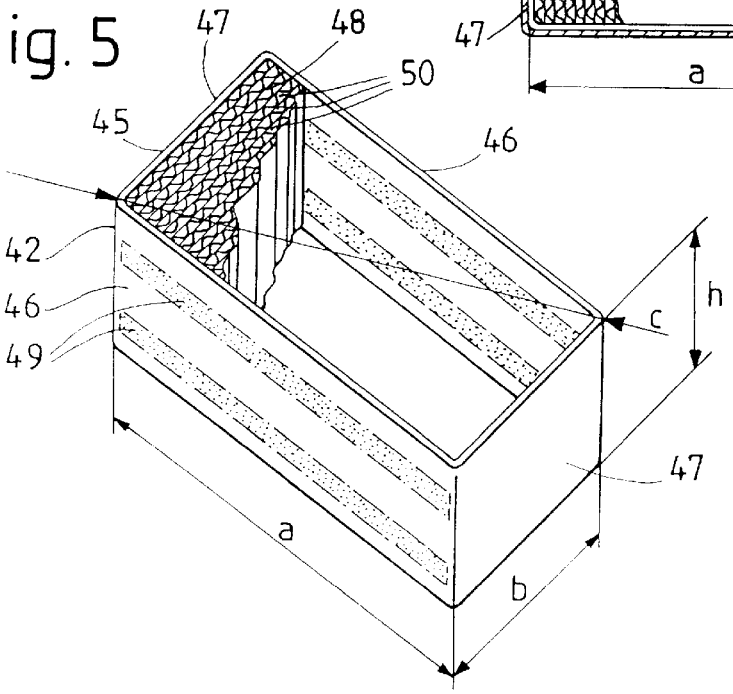
FIG. 5 shows an oblique view of a catalyst member of the catalyst means and FIGS. 6 to 8 show sections, analogous to FIG. 3, through individual pipes of other exhaust manifolds.

The catalytic converter section 18 of each individual pipe 12 contains catalyst means 41 for the catalytic treatment of the exhaust gas flowing through the relevant pipe 12. The catalyst means 41 present in a catalytic converter section have at least one catalyst member 42 and, for example, two catalyst members 42 arranged one behind the other in the direction of flow of the exhaust gas. These catalyst members are, for example, identically formed and have the shape of a parallelepiped. One of the catalyst members 42 is shown separately in FIG. 5 and has a sleeve 45 which is quadrilateral, namely rectangular, in cross-section and has two flat first walls 46 parallel to one another and two flat second walls 47 parallel to one another. The sleeve 45 contains a package 48 of alternate first, flat sheet metal members and second, wavy sheet metal members. The sheet metal members are quadrilateral in plan view. The first, flat sheet metal members are parallel to the second walls 47. The waves of the second sheet metal members are parallel to the axis of the sleeve 45. The successive sheet metal members touch one another at the wave summits of the second sheet metal members. Each edge of the sheet metal members which is parallel to the waves abuts one of the first walls 46 and is firmly connected to the relevant wall 46, at least at an edge section and, for example, at two edge sections a distance apart, by a weld joint indicated in FIG. 5 and denoted by 49. Those edges of the sheet metal members which are at right angles to the waves are at least almost flush with the edges of the walls of the sleeve and form, at the two ends of the sleeve, a flat end surface which serves as an exhaust gas entry surface or exhaust gas exit surface. The sheet metal members have a core of steel and coatings which comprise porous metal oxide and catalytically active material, namely platinum and rhodium. The successive sheet metal members together in pairs bound exhaust gas passages 50 which run from the exhaust gas entry surface to the exhaust gas exit surface.

The thickness of the metallic cores of the sheet metal members is preferably not more than 0.1 mm and, for example, about 0.05 mm. The thickness of a sheet metal member having coatings on two surfaces facing away from one another is not more than 0.3 mm and, for example, about 0.1 mm to 0.15 mm. Each corrugated, coated sheet metal member has a wave height which is measured at one and the same surface, from wave summit to wave summit. This wave height is preferably not more than 1.5 mm, better at most 1 mm, preferably at least 0.1 mm, and, for example, from about 0.3 mm to 0.8 mm. The wavelength may be, for example, from about 1 mm to 2 mm. In a cross-section at right angles to the corrugations and exhaust gas passages, a package of sheet metal members has preferably at least 150 passages per $cm^2$ and, for example, about 180 to 200 passages per $cm^2$ of cross-sectional area.

The sleeves 45 of the catalyst members 42 fit tightly or with at most little play in the catalytic converter section 18 of each pipe 12 and are firmly connected, for example welded, to the wall of the catalytic converter section. The exhaust gas entry surface of the catalyst member 42, which surface is present at the upper end of said member in FIG. 3, forms the exhaust gas entry surface 51 of the entire catalyst means 41. The exhaust gas exit surface 53 present at the lower end of the lower catalyst member 42 forms the exhaust gas exit surface of the entire catalyst means 41. The entry surface 51, the exit surface 53 and those end surfaces of the two catalyst members which face one another are perpendicular to the catalytic converter and discharge axis 33. The exhaust gas entry surface 51 is approximately flush with the upper end of the second limb 17. Each pipe 12 has a passage 55 which, apart from the region occupied by the catalyst means, consists of free cavities. That longitudinal section of the passage of the pipe 12 which is bounded partly by the wall of the exhaust gas distributor 16 and, on the side located at the bottom in FIG. 3, by the exhaust gas entry surface 51 is referred to below as exhaust gas distribution space 56. A narrow intermediate space 57 is present between the two catalyst members of each pipe 12. The exhaust gas passages 50 of the two catalyst members are essentially parallel to the axis 33 from the entry surface 51 to the exit surface 53, said passages being divided by the intermediate space 57 between the two catalyst members. That section of the passage 55 which is directly adjacent to the exit surface 53 and is enclosed in cross-section by the discharge section 19 of the limb 17 is referred to as discharge space 58. Furthermore, the passage section contained in the transition section 20 is referred to as transition space 59.

The inlet axis 31 intersects the catalytic converter and discharge axis 33 at an angle $\alpha$ of 45° to 135° and preferably about 60° to 120°. For clarification, it should be noted that the angle $\alpha$ is measured between a section of the inlet axis 31 lying within the inlet and a section of the catalytic converter axis lying within the catalytic converter section. The second limb 17 is inclined, for example, downward away from the inlet orifice 32, so that the angle $\alpha$ is an obtuse angle and is more than 90° when measured on the lower, inner side of the apex formed by the two axes 31, 33. The exhaust gas entry surface 51 of the catalyst means, which surface is at right angles to the axis 33, accordingly makes an acute angle $\beta$ of at most about 45° with the inlet axis 31. The exhaust gas distribution space 56 has a cross-sectional area, measured perpendicular to the inlet axis 31, which decreases at least approximately and, for example, exactly linearly with the distance from the inlet orifice in a direction away from the inlet orifice 32 along the inlet axis 31 and is approximately zero at that edge of the entry surface 51 which is furthest away from the inlet orifice.

The circular inlet orifice 32 has a diameter d. The approximately horizontal inlet 15 of each pipe 12 may be short so that the exhaust gas entry surfaces 51 of the catalyst means are relatively close to the inlet orifice 32 of the relevant pipe. That point of the exhaust gas entry surface 51 of the catalyst means 41 which is closest to the inlet orifice 32—i.e. the lower edge of the exhaust gas entry surface in FIG. 3—is a distance from the flat entry surface of the inlet, measured parallel to the inlet axis, of, for example, at most twice the diameter d of the inlet orifice or even only at most one diameter d and preferably at most 5 cm and, for example, only approximately 1 cm to 3 cm.

In a cross-section at right angles to the axis 33 and to the exhaust gas passages 50, the catalyst member 42 forms a rectangle and has a cross-sectional dimension or length a parallel to the longer side of the rectangle, the cross-sectional dimension or width b parallel to the shorter side of the rectangle and the maximum cross-sectional dimension c measured along the diagonal of the said rectangle. A catalyst member 42 has the dimension or height h parallel to the axis 33 and to the exhaust gas passages 50. That section of the passage 55 of a pipe 12 which is bounded by the catalytic converter section 18 forms, in cross-section, a rectangle whose longer side is parallel to a plane passing through the axes 31 and 33 and has a length which is approximately the dimension a of the catalyst member arranged with at most little play in the limb 17 or is slightly larger than a. The dimension a is larger, namely at least 30%, preferably at least 50% or even at least 100% larger, than the diameter d of the inlet orifice 32. The diameter d and the dimension a are for instance approximately 25 mm to 35 mm and 60 mm to 80 mm, respectively. The cross-sectional dimension or width b of the catalyst members and the approximately equal or at most slightly larger cross-sectional dimension of the passage section bounded by the catalytic converter section, measured at right angles to the plane through the axes 31, 33, is, for example, approximately the same magnitude as the diameter d or at most slightly smaller than this but could be substantially larger than the diameter d. That rectangular cross-sectional area of the catalyst members 42 which is at right angles to the catalytic converter axis 33 and to the exhaust gas passages 50 is greater, namely at least 30%, preferably at least 50% and, for example, at least 100% greater, than the circular area of the inlet orifice 32.

Since the catalytic converter section 18 and the discharge section 19 consist of a casing parallel to the straight catalytic converter and discharge axis 33, they do of course have straight walls flush with one another. Furthermore, the discharge space 58 has the same cross-sectional shape and the same cross-sectional dimensions as the interior space of the catalytic converter section 18. The dimension e of the discharge section 19 and of the discharge space 58 present therein is measured parallel to the axis 33 and is at least 10% and, for example, approximately or at least 20% of the maximum, diagonal cross-sectional dimension c and of course also at least 10% and preferably at least 20% of the cross-sectional dimension a of the catalyst member.

The wall of the transition section 20 forms the transition from the discharge section 19, which is rectangular in cross-section, to the connecting section 21 which is circular in cross-section and whose internal diameter is, for example, approximately equal to the diameter d of the inlet orifice 32. The transition axis 36 makes an angle γ with the catalytic converter and discharge axis 33. Said angle is measured between a section of the axis 33 lying within the limb 17 and a section of the axis 36 lying within the transition section 20 and is preferably 135° to 225° and, for example, 150° to 210°. The wall of the transition section 20 may be parallel to the transition axis 36 in parts but is inclined relative to the transition axis 36, at least in certain circumferential regions. However, the angle between the wall of the transition section 20 and the transition axis 36 may be at most 45° or even at most 30° around the entire transition section, at every point of its wall. Furthermore, at least in parts, the wall of the transition section 20 may also make an angle with the catalytic converter and discharge axis 33, which angle however may likewise be at most 45° everywhere. The wall of the transition section 20 accordingly makes an angle of at least 45° with the exhaust gas exit surface 53 at all points of the wall.

The axial dimension or height h of the catalyst member can of course be established so that sufficient, catalytic purification of the exhaust gas is achieved. The dimension or height h is, for example, in the range from 2 cm to 5 cm. The main sections 23 are substantially longer than the inlets 15 and the catalytic converter sections 18. The lengths of the individual pipes 12 are tailored to the intended speed range and the other properties of the internal combustion engine 1 in such a way that the exhaust gas pulses emitted by one of the combustion chambers 3 during operation of the engine have no effect on the function of the other combustion chambers in terms of impairing the engine power, in spite of the high pressure peaks at the inlets 15 of the exhaust manifold 11. Each individual pipe 17 may be, for example, at least 0.5 m or at least 1 m long. The length of the exhaust gas flow path from an inlet orifice 32 to the common outlet 28 of the exhaust manifold is then, for example, in the range from 0.7 m to 1.5 m.

The formation of the catalyst members 42 of flat and wavy sheet metal members permits—as already written—a large number of exhaust gas passages 50 per unit of cross-sectional area of the catalyst members. The surfaces bordering the exhaust gas passages form accordingly together a large surface per volume unit of the packages of sheet metal members, which surface is effective for treating the exhaust gas. The catalyst means therefore require only little space and can easily be installed close to the inlet orifices 32 of the pipes 12, in said pipes. Furthermore—based on the quantity of exhaust gas fed to the exhaust gas system 11 per unit time—the catalyst means 41 can be economically produced and installed. The exhaust gas produced by the internal combustion engine 1 during operation of the latter and fed to the inlets 15 of the various pipes 12 of the exhaust manifold is distributed in the exhaust gas distribution space 56 of each pipe uniformly over the entire exhaust gas entry surface 51 of the catalyst means 41 and then flows through the two catalyst members in succession. Since, after emerging from the exhaust gas exit surface 53 of the catalyst means, the exhaust gas additionally continues to flow for some way essentially parallel to the catalytic converter axis and parallel to the exhaust gas passages and is furthermore only relatively slight deflected in the transition section 20, there is a virtually constant pressure in the discharge space 58 over the entire exhaust gas exit surface 53. This ensures that the exhaust gas flow density has virtually the same magnitude in all passages of the catalyst means. Furthermore, the large cross-sectional areas of the catalyst means, the guidance of the exhaust gas before and after the catalyst means and the uniform distribution of the exhaust gas over the entire cross-sectional area of the catalyst means help to achieve low resistance to flow so that the catalyst means and the guidance of the exhaust gas directly upstream and downstream thereof increase the opposite pressure generated by the exhaust gas only relatively slightly compared with an exhaust manifold without catalyst means.

Figure 6:
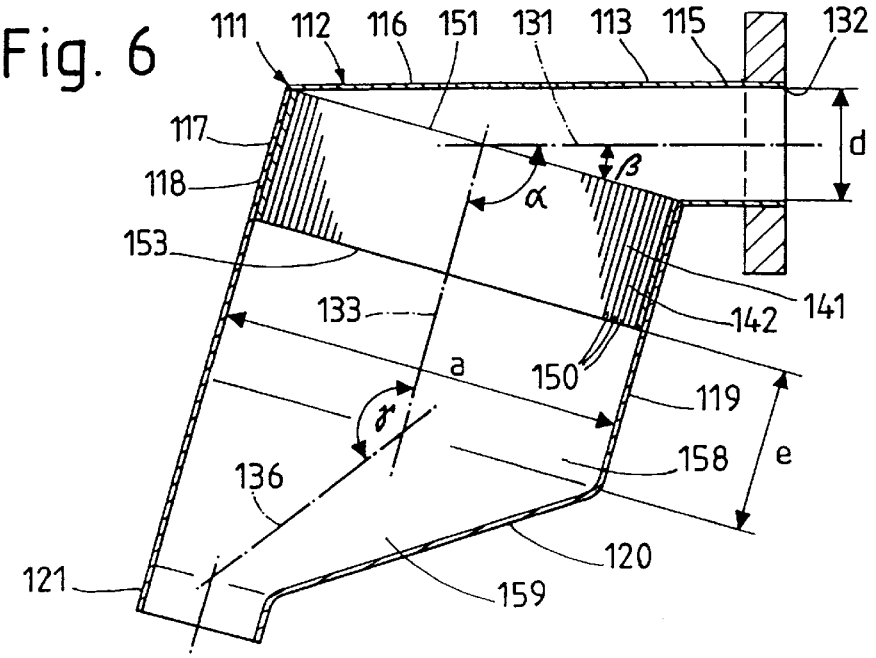

FIG. 6 shows a part of one of the individual pipes 112 of an exhaust manifold 111. The pipe 112 has a first, approximately horizontal limb 113 with an inlet 115 and an exhaust gas distributor 116. This is connected to a second limb 117 projecting downward away from it. Said limb 117 has, in sequence in a direction away from the first limb 113, a catalytic converter section 118, a discharge section 119, a transition section 120 and a connection section 121. The inlet 115 defines an approximately horizontal inlet axis 131 and has a circular inlet orifice 132. The walls of the inlet 115 and of the exhaust gas distributor 116 are formed similarly to those in the pipes 12 shown in FIGS. 1 to 4. The catalytic converter section 118 and the discharge section 119 have a common, straight catalytic converter and discharge axis 133 and together consist of a straight pipe section or casing which is parallel to said axis and rectangular in cross-section. The transition section defines a transition axis 136 and connects the lower end of the rectangular limb 117 to the connecting section 121 which is circular in cross-section, for example cylindrical. Said connecting section has, for example, an axis which is parallel to the axis 133 but offset to its side facing away from the inlet orifice 132. The catalytic converter section 118 contains catalyst means 141, which however have only a single catalyst member 142. This has exhaust gas passages 150 parallel to the axis 133, an exhaust gas entry surface 151 and an exhaust gas exit surface 153. The catalyst member 142 once again has a parallelepiped shape, forms a rectangle in a cross-section at right angles to the axis 133 and to the passages 150 and has, parallel to the longer side of the rectangle, the cross-sectional dimension a shown in FIG. 6 and a maximum cross-sectional dimension c which is not shown in FIG. 6 and is measured along the diagonal of the rectangle. The discharge section 119 contains a discharge space 158 directly adjacent to the exit surface 153, and the deflecting section 120 contains a deflecting space 159.

The catalytic converter and discharge axis 133 makes an angle α with the inlet axis 131. The exhaust gas entry surface 151 makes an angle β with the inlet axis 131. The angles α and β are in the same ranges as in the case of the pipes 12. In the pipe 112 shown partly in FIG. 6, the dimension e of the discharge section 119 and discharge space 158, measured parallel to the catalytic converter and discharge axis 133, is at least about 30% and, for example, even at least 40% of the cross-sectional dimension a and also at least 25% or even at least 30% of the maximum, diagonal cross-sectional dimension c of the catalyst member 142. In this embodiment, the transition section 120 has, on the right side in FIG. 6, for example a wall which makes a fairly large angle with the axis 133 and accordingly a relatively small angle with the exhaust gas exit surface. Furthermore, the angle made by the axes 133 and 136 also differs to a relatively great extent from 180°. Exhaust gas is thus deflected to a greater extent in the transition space 159 of the pipe shown in FIG. 6 than in the transition space 59 shown in FIG. 3. However, owing to the large dimension e of the discharge section 119 having walls parallel to the catalytic converter and discharge axis 133 and of the discharge space 158 present in said discharge section, the design of the deflecting section 120 in the pipe according to FIG. 6 has virtually no effect on the exhaust gas distribution in the catalyst member 142. The exhaust gas flow is therefore virtually completely uniformly distributed over the cross-sectional area of the catalyst member in the catalyst member 142 as well as in the catalyst members 42 of a pipe 12.

Figure 7:
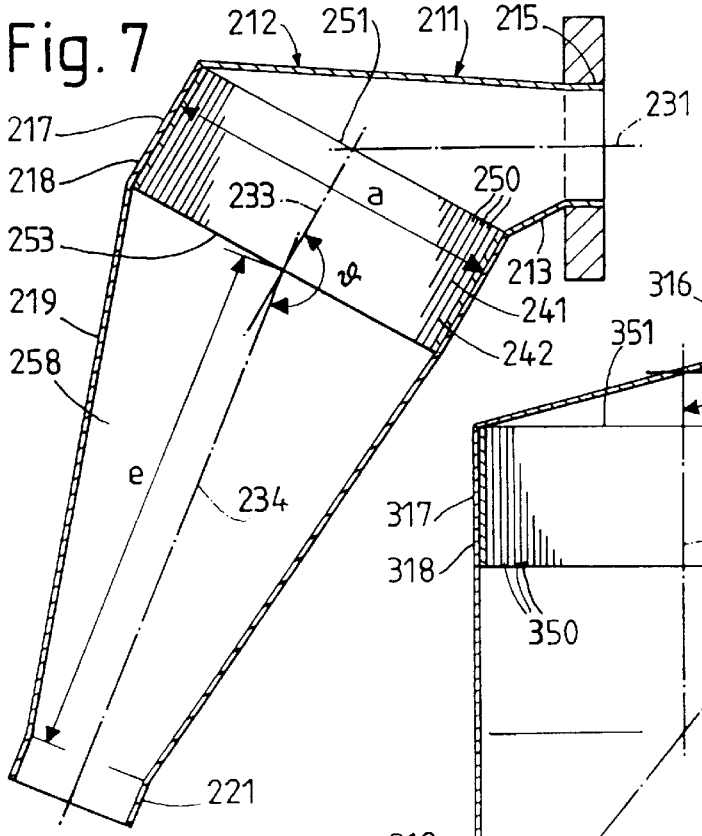

The individual pipe 212 of an exhaust manifold 211, shown in FIG. 7, has a first, approximately horizontal limb 213 with an inlet 215 and a second, downward-projecting limb 217 with a catalytic converter section 218 which is quadrilateral, namely rectangular, in cross-section. This is connected to a discharge and transition section 219 which is connected at its lower end to a connecting section 221 which is circular in cross-section. The inlet and the catalytic converter section define an inlet axis 213 and a catalytic converter axis 233, respectively. The discharge section and transition section 219 define a discharge and transition axis 234 which is flush with the catalytic converter axis 233 or makes an angle θ with said axis. The catalytic converter section 218 contains catalyst means 241 which, for example, consist of a single, parallelepiped catalyst member, contain exhaust gas passages 250 and have an exhaust gas entry surface 251 and an exhaust gas exit surface 252. The discharge and transition section 219 encloses in cross-section a discharge and transition space 258 which is adjacent to the exhaust gas exit surface 253 and has the dimension e along the axis 234 and parallel to this.

In the pipe 212, the discharge space 258 adjacent to the exhaust gas exit surface 253 therefore simultaneously forms the transition space and makes the transition from the rectangular exit surface 253 to the circular passage section of the connecting section 221. The wall of the discharge and transition section 219 accordingly makes angles with the catalytic converter axis 233, at least in parts. These angles should be at most 45°, preferably at most 30°, better at most 25° and even better at most 20°, preferably everywhere and in particular at every circumferential point on the edge of the exhaust gas exit surface 253. The wall of the discharge and transition section 219 then also makes non-90° angles with the exhaust gas exit surface 253, at least in parts. These angles should be at least 45°, preferably at least 60° and better at least 65° or at least 70°, preferably at all edge points of the exit surface 253. In the case of the pipe 212, the dimension e of the discharge and transition space 258 is, for example, at least equal to the cross-sectional dimension a and also at least equal to the maximum, diagonal cross-sectional dimension c of the catalyst means. The angle θ is measured in a manner analogous to that explained above for the angles α and γ and differs from a straight line—i.e. 180°—by preferably at most 45°, for example at most 30°, better at most 25° and even better at most 20° and is thus preferably 135° to 225°, for example 150 to 210°, better 155° to 205° and even better 165° to 200°.

Figure 8:
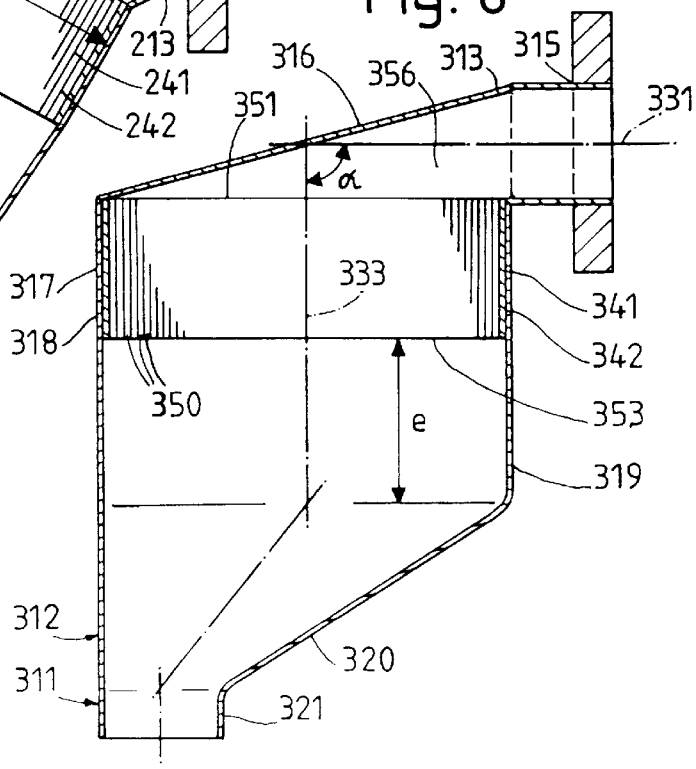

FIG. 8 shows an individual pipe 312 of an exhaust manifold 311. The pipe 312 has a first approximately horizontal limb 313 with an inlet 315 and an exhaust gas distributor 316 and a second limb 317 projecting downward away from the first limb 313. Said limb 317 has a catalytic converter section 318, a discharge section 319, a transition section 320 and a connecting section 321. The inlet has an approximately horizontal inlet axis 331. The catalytic converter section and the discharge section have a common catalytic converter and discharge axis 333. The catalytic converter section contains catalyst means 341 which have at least one catalyst member 342 with exhaust gas passages 350, an exhaust gas entry surface 351 and an exhaust gas exit surface 353. The wall of the exhaust gas distributor 316 together with the entry surface 351 of the catalyst means bounds an exhaust gas distribution space 356.

The catalytic converter and discharge axis 333 makes an angle a with the inlet axis 331, which angle in this pipe is approximately or exactly 90°. The exhaust gas entry surface 351 is accordingly approximately parallel to the inlet axis 331. That wall of the exhaust gas distributor 316 which is opposite the entry surface 351 is approximately flat and is inclined downward away from the inlet toward the entry surface 351. In a cross-section at right angles to the inlet axis, the exhaust gas distribution space 356 has a cross-sectional area which once again decreases linearly away from the inlet. The second limb 317 is otherwise formed, for example, similarly to that in the pipe shown in FIG. 6.

Unless stated otherwise above, the exhaust manifolds shown in FIGS. 6 to 8 may be formed similarly to the exhaust manifold described first with reference to FIGS. 1 to 5 and may have properties similar to those of this exhaust manifold.

The internal combustion engine 1 and the exhaust systems may furthermore be modified in various respects. For example, features of different embodiments described may be combined with one another.

The angle α is preferably an obtuse or right angle but may also be an acute angle and—as already mentioned—may be approximately in the range from 45° to 135°. The catalyst means may have a square cross-sectional area and, for example, at least one cube-shaped catalyst member.

The connecting plate 26 may be replaced, for example, by separate annular flanges, each of which is fastened to one of the pipes. Furthermore, each catalyst member may have two or more sleeves, each of which contains a package of sheet-metal members. The sleeves belonging to the same catalyst member may then rest against one another with facing walls and may be welded to one another or rigidly connected to one another in another manner.

Furthermore, the engine may have more or less than four cylinders and may have a corresponding number of exhaust gas outlets. The number of individual pipes of the exhaust manifold can then accordingly be more or less than four. Furthermore, it is possible to provide an exhaust system having two exhaust manifolds, each of which has inlets connected to a group of the exhaust gas outlets of the engine and an outlet connected to an exhaust pipe.

What is claimed is:

1. An exhaust manifold, comprising:

at least two pipes each having a first limb forming an inlet connectable to an internal combustion engine, and a second limb extending at an angle to the first limb; and a catalytic converter section located in the second limb and containing catalyst means for catalytic treatment of exhaust gas, the catalytic converter section defining a catalytic converter axis, wherein the inlet defines an inlet axis and has an inlet orifice with an inlet orifice area, wherein the catalyst means has a substantially flat exhaust gas entry surface forming an angle with the inlet axis and having a cross-sectional area extending perpendicular to the catalytic converter axis, wherein the first limb has a gas distributor having two opposite, substantially flat, lateral wall sections extending parallel to a plane passing through the inlet axis and the catalyst converter axis, wherein the exhaust gas entry surface is substantially quadrilateral and has two quadrilateral sides extending parallel to the plane passing through the inlet and catalyst converter axes, wherein the gas distributor has further a substantially flat wall section extending perpendicular to the lateral wall sections thereof, the substantially flat wall section being arranged opposite the exhaust gas entry surface and approaching same in a direction away from the inlet orifice, and wherein the gas distributor defines together with the exhaust gas entry surface a gas distributor space having a cross-sectional area extending perpendicular to the inlet axis and decreasing linearly in a direction away from the inlet orifice.

2. An exhaust manifold as claimed in claim 1, wherein the inlet axis makes an angle $\alpha$ of at least 45° and at most 135° with the catalytic converter axis.

3. An exhaust manifold as claimed in claim 1, wherein each pipe has a hollow exhaust gas distribution space which is adjacent to the exhaust gas entry surface and has a cross-sectional area which is a right angle to the inlet axis and decreases essentially linearly in a direction away from the inlet.

4. An exhaust manifold as claimed in claim 1, wherein the exhaust gas entry surface makes an acute angle $\beta$ with the inlet axis.

5. An exhaust gas manifold as claimed in claim 1, wherein the catalyst means have exhaust gas passages generally parallel to the catalytic converter axis and an essentially flat exhaust gas exit surface, and wherein the exhaust gas entry surface and the exhaust gas exit surface are perpendicular to the catalytic converter axis.

6. An exhaust manifold as claimed in claim 1, wherein each pipe has a discharge section which connects to the catalyst means and defines at least approximately a discharge axis which is flush with the catalytic converter axis and/or makes an angle $\theta$ of 135° to 225° with said axis and has a dimension e, measured along the discharge axis and parallel to said axis, which is at least 10% of the maximum cross-sectional dimension c of the catalyst means.

7. An exhaust manifold as claimed in claim 6, wherein the catalyst means have an exhaust gas exit surface and the discharge section has a wall which, at its end located at the exhaust gas entry surface, is parallel to the catalytic converter axis at all circumferential points or makes an angle of at most 45° with said axis.

8. An exhaust manifold as claimed in claim 1, wherein the catalyst means arranged in each pipe have at least one essentially dimensionally stable, essentially parallelepiped or cube-shaped catalyst member and each catalyst member has at least one package of alternate, essentially flat and wavy sheet metal members which have coatings of catalytically active material and together bound exhaust gas passages.

9. An exhaust manifold as claimed in claim 8, wherein each of said packages of sheet metal members includes at least 150 exhaust gas passages per $cm^2$ of cross-sectional area in a cross-section perpendicular to said exhaust gas passages.

10. An exhaust manifold as claimed in claim 1, wherein the cross-sectional area of the catalyst means is at least 30% greater than the inlet orifice area.

11. An exhaust manifold as claimed in claim 1, wherein the exhaust gas entry surface has a width measured in a direction perpendicular to the plane passing through the inlet and catalyst converter axes and approximately equal to a diameter of the inlet orifice.

12. An exhaust manifold as claimed in claim 1, wherein each inlet orifice is directly connected to a respective exhaust outlet of the engine, and wherein the exhaust gas entry surface has a third quadrilateral side extending perpendicular to the plane passing through the inlet and catalyst converter axes and spaced from the orifice a distance which, measured parallel to the inlet axis, is equal at most twice a diameter of the inlet orifice.

13. An exhaust gas manifold as claimed in claim 1, wherein each inlet orifice is directly connected to a respective exhaust outlet of the engine, and wherein the exhaust gas entry surface has a third quadrilateral side extending perpendicular to the plane passing through the inlet and catalyst converter axes and spaced from the orifice a distance which, measured parallel to the inlet axis, is equal at most a diameter of the inlet orifice.

14. An exhaust gas manifold as claimed in claim 1, wherein each inlet orifice is directly connected to a respective exhaust outlet of the engine, and wherein the exhaust gas entry surface has a third quadrilateral side extending perpendicular to the plane passing through the inlet and catalyst converter axes and spaced from the orifice a distance which, measured parallel to the inlet axis, is equal at most 5 cm.

15. An exhaust manifold as claimed in claim 1, wherein the inlets of at least two pipes are provided with one of a common plate and separable flanges for fastening the pipes to an engine housing, the one of a common plate and separate flanges defining respective inlet orifices.

16. An exhaust manifold as claimed in claim 1, wherein the exhaust gas entry surface is formed as a rectangle two longer sides of which are formed by the two quadrilateral sides.

17. An exhaust manifold as claimed in claim 1, wherein the inlet orifice is circular, and wherein the two quadrilateral sides have a length greater than a diameter of the inlet orifice.

18. An exhaust manifold, comprising:

at least two pipes each having a first limb forming an inlet connectable to an internal combustion engine, and a second limb defining a longitudinal direction, and a catalytic converter section located in the second limb and containing catalyst means for catalytic treatment of exhaust gas, the catalytic converter section defining a catalytic converter axis forming an angle with the longitudinal direction defined by the first limb, wherein the inlet has an inlet orifice, having an inlet orifice area, wherein the catalyst means has a substantially flat exhaust gas entry surface inclined to the longitudinal direction and having substantially a shape of a rectangle with two longer edges and two shorter edges, with the shorter edges extending perpendicular to the longitudinal direction and the longer edges extending one of inclined to and parallel to the longitudinal direction, and wherein the catalyst means has a cross-sectional area cross-sectional elements of which extend at right angles to the catalytic converter axis, the cross-sectional area of the catalyst means being greater than the inlet orifice area.

19. An exhaust manifold as claimed in claim 18, wherein the inlet has a circular inlet orifice, and wherein at least one of the shorted edges is spaced from the inlet orifice, in the longitudinal direction defined by the first limb, a distance equal at most two times a diameter of the inlet orifice.

20. An exhaust manifold as claimed in claim 18, wherein the inlet has a circular inlet orifice, and wherein at least one of the shorted edges is spaced from the inlet orifice, in the longitudinal direction defined by the first limb, a distance equal at most to a diameter of the inlet orifice.

21. An exhaust manifold as claimed in claim 18, wherein the inlet has a circular inlet orifice, and wherein the shorter edges have a length equal at most to a diameter of the inlet orifice.

22. An exhaust manifold as claimed in claim 18, wherein the catalyst means includes at least one catalyst member having a shape of a parallelepipid and at least one package of alternating, substantially flat metal members and corrugated metal members having a coating of a catalytically active material and defining together exhaust gas passages.

23. An exhaust manifold as claimed in claim 22, wherein the catalyst member has at least 150 passages per $cm^2$ of cross-sectional area.

24. An exhaust manifold as claimed in claim 22, wherein the catalytic converter section includes one of one catalyst member and two catalyst members, and wherein the catalyst member has a height measured along the catalyst converter axis and equal at most 5 mm.

* * * * *